US008552279B2

(12) United States Patent
Rohner et al.

(10) Patent No.: US 8,552,279 B2
(45) Date of Patent: Oct. 8, 2013

(54) METHOD FOR PRODUCTION OF A METALLIC-SOUNDING MUSICAL INSTRUMENT

(75) Inventors: Felix Rohner, Bern (CH); Sabina Scharer, Bern (CH)

(73) Assignee: Panart Hangbau AG, Bern (CH)

( * ) Notice: Subject to any disclaimer, the term of this patent is extended or adjusted under 35 U.S.C. 154(b) by 0 days.

(21) Appl. No.: 13/378,488

(22) PCT Filed: Jun. 16, 2009

(86) PCT No.: PCT/EP2009/057466

§ 371 (c)(1), (2), (4) Date: Dec. 15, 2011

(87) PCT Pub. No.: WO2010/145695

PCT Pub. Date: Dec. 23, 2010

(65) Prior Publication Data

US 2012/0304845 A1 Dec. 6, 2012

(51) Int. Cl.
*G10D 13/08* (2006.01)

(52) U.S. Cl.
USPC ..... 84/402

(58) Field of Classification Search
USPC ..... 84/402–410
See application file for complete search history.

(56) References Cited

U.S. PATENT DOCUMENTS 6,212,772 B1 4/2001 Whitmyre et al.
2009/0193958 A1 * 8/2009 Webb ..... 84/406

FOREIGN PATENT DOCUMENTS

CH 693319 A5 5/2003

OTHER PUBLICATIONS

Rohner, et al., "History Development and Tuning of the Hang" ISMA 2007, 2007, pp. 1-8.
International Search Report for PCT/EP2009/057466 dated Mar. 2, 2010.

* cited by examiner

*Primary Examiner* — Kimberly Lockett
(74) *Attorney, Agent, or Firm* — Pearne & Gordon LLP

(57) ABSTRACT

Indicated is a method for production of a metallic-sounding musical instrument of the steelpan-type, in particular for production of a Hang®. In the method the steel sheet with a thickness of 0.75 to 1.25 mm required for the production is nitrided until the sheet is completely permeated with iron nitride needles. The linear density of the needles is, as a rule, between $40 \cdot 10 \cdot 10^3$ $m^{-1}$ to $80 \cdot 10^3$ $m^{-1}$. The type of nitriding can be selected freely. The thus obtained instrument is characterized by novel tones.

17 Claims, 1 Drawing Sheet

METHOD FOR PRODUCTION OF A METALLIC-SOUNDING MUSICAL INSTRUMENT

Figure 2:
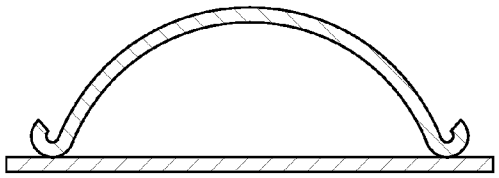

The invention relates to a method for production of a metallic-sounding musical instrument, in particular a so-called Hang®. The term Hang® is protected in several countries as a registered trademark.

The Hang® is a lens-shaped musical instrument belonging to the idiophone family. It consists of two shells made out of treated sheet steel and joined together. Both halves are tuned into a harmonic whole by hammering, like the steelpans of Trinidad. On the upper half shell are tuned regions or tone fields which are worked into the sheet steel by hammering.

The playing possibilities of the Hang® are very diverse. The creators have tuned it in such a way that it can develop its richness on the lap of the player. It is played with the fingers and hands, which gave it its name: "Hang" is Bernese German for "hand". The instrument was developed in the year 2000 by two Swiss instrument makers.

The body of the Hang® has in particular a diameter of about 53 cm and a height of about 24 cm. On the one, upper side are seven tone fields arranged in a circle around a tone field, the "Ding", disposed in the middle. Located opposite, in the middle of the lower half shell is the Gu, a round resonance opening, the size of a hand, with a neck opening inwardly. Other dimensions and arrangements are also possible, however.

The upper half shell of the Hang® is also called the Ding side, the lower the Gu side.

Until 2007 the Hang® was offered in a multiplicity of sound models. They differ in the tone pitch of the Ding (between pitch D natural 3 and pitch B natural 3), the number of tone fields in the tone circle (seven or eight) and the tuned tone scale (between pitch G flat 3 and pitch F natural 5). Since 2008 only one model, the integral Hang®, is being made.

Further information about the Hang® can be learned from the Internet encyclopedia Wikipedia, from which come most of the details above.

When playing the Hang® surprisingly pleasant-sounding, gong-like tones with high dynamic are produced. It is however desirable to achieve a more balanced sound pattern as well as to refine the multi-dimensional quality of the sound. It has been shown that the sound quality of the Hang® is closely connected with the inner structure of the material used and its hardness or strength, which is already known in principle by players of brass wind instruments. Thus the object of the invention is to expand the richness of tone of the instrument.

Known from the Swiss printed patent specification No. 693319 (Panart Steelpan-Manufaktur AG) is a method for production of sheet-metallic-sounding musical instruments in which, following some mechanical preliminary work, starting with a steel sheet, a hardening of this sheet is carried out. Mentioned as hardening methods in the patent publication are a gas nitriding, a nitrocarburizing in gas at 550 to 650° C., a nitrocarburizing in bath at 560 to 620° C. and a plasma nitriding at 400 to 600° C.

Described in the patent publication is that with these nitriding steps a surface hardening is achieved of the deep-drawn metal sheet cutout used as the starting material, and that a soft, ferritic inner layer remains between the two hardened surface layers.

Surprisingly it has now been found that an exhaustive nitriding, i.e. a nitriding also of the inner ferritic layer, produces the desired new sound quality; surprising furthermore, and something which could also not be expected, is that the rather soft sound dynamic during suitable playing of the instrument has also not been lost, but instead is even heightened.

Such a thorough nitriding throughout increases the internal stress and the energy storage capacity of the material, and thereby makes possible a soft, harmonic sound quality, even when the instrument is played with the bare hands.

The thorough nitriding throughout increases the strength, elasticity and stiffness of the material, which means more design possibilities for the instrument maker, such as, for example, more possibilities for the internal stress and for tuning.

The method according to the invention is accordingly defined in the first independent claim. Special or preferred embodiments form the subject matter of the dependent claims. Furthermore the present invention also encompasses the metallic-sounding musical instrument obtained according to the new method.

The method according to the invention is characterized by a complete nitriding throughout of the material of which the metallic sounding instrument consists, as will be explained further below in detail. The nitriding of steel for the purpose of improving its mechanical properties has been known already for a long time. Many different nitriding methods exist, which in part differ from one another only slightly. An overview of steel nitriding is found in the *Härterei Handbuch*, chapter on nitriding techniques, Rübig u. Ipsen, EFD-Härterei, EFD-Archive 2006.

The nitriding can be carried out in the most diverse ways. The success of the method according to the invention is not dependent upon the type of nitriding process. The nitriding can be carried out as gas nitriding using nitrogen-releasing compounds such as ammonia, hydrazine, etc., by nitrocarburization (less preferable), by plasma nitriding, by vacuum nitriding, etc. These methods are known to one skilled in the art.

In general the nitriding takes place at elevated temperatures. The nitriding in the gas phase using ammonia runs at a temperature of 380 to 600° C. With (not preferable) nitrocarburization, temperatures between 550 and 620° C. are recommended. The nitriding must be continued until the metal sheet is completely nitrided throughout; nitriding times of more than 100 hours can be necessary, which of course also depends on the thickness of the metal sheet used. In the present method metal sheets are generally used having a thickness of 0.75 to 1.25 mm, usually those having a thickness of 0.9 or 1 mm. Of course there is an interrelationship between duration, concentration of the nitriding agent, temperature and workpiece thickness; ideal conditions can easily be determined by simple trials.

The nitriding according to the invention is carried out in such a way that the starting metal sheet is nitrided "exhaustively" so to speak, i.e. the nitriding is carried out under conditions under which a soft inner layer remaining according to the state of the art, in general a ferritic layer, is also nitrided. In relation to a common surface nitriding, the conditions of such an exhaustive nitriding are generally more stringent conditions, for example longer nitriding times (more than 100 hours), higher gas density with the gas nitriding, higher temperatures (whereby there is an upper limit which should not be exceeded since then the nitrides formed begin to disintegrate again), selection of thinner metal sheets for the instrument, selection of suitably alloyed steels, etc. The nitriding throughout can also run more quickly, but it has been shown that the acoustical quality of the material is significantly higher if the nitriding throughout is carried out more slowly. This is to be attributed to the increased anisotropy and even distribution of the nitride needles thereby formed as well as to the increased uniformity of the length of these needles. When the nitride needles form more slowly, they can also grow through grain boundaries of the material (e.g. steel), and thereby bring about a fundamental change of the physical properties of the material.

The metal nitrided throughout also facilitates a better control of the boundary conditions during the treatment of the sheet metal as well as an elevated hardening capability. This is important if the metal is tempered after and/or during the treatment or respectively tuning.

Whether the selected conditions lead to a complete nitriding throughout can be easily determined by an analysis, for example by creation of a polished micrograph section which is then suitably stippled or deep-etched. The analysis is completed by viewing the polished micrograph section under the microscope.

As is well known, during nitriding, for instance during gas nitriding in an ammonia atmosphere, a so-called connection layer first forms on the two surfaces, in which a lot of iron is present as ϵ-nitride ($Fe_2N.Fe_3N$) and γ-nitride ($Fe_4N$)). The so-called diffusion zone or precipitation layer in which needle-shaped nitrides are precipitated and are embedded in an iron matrix then follows inwardly. The matrix present with a partial nitriding is not present here, according to the invention, owing to the nitriding throughout.

For the success of the method according to the invention it is important that the needle-shaped iron nitrides are to be found everywhere in the structure of the nitrided sheet metal (with the exception of the two connection layers); this is proof that a nitriding throughout has taken place. Aimed at in particular is a certain density of the precipitated crystal needles; it has been found that the best sound characteristics are generated in a certain density range, which will be specified further below.

Since it is very difficult to determine the number of needles of the iron nitrides (and also of the nitrides of the accompanying elements, e.g. manganese) in a unit of volume, the needle density is measured and indicated as so-called linear density, according to a proposal of the inventor. A polished micrograph section of a cross section of the material is thereby created and suitably etched to make the needles visible. A solution of nitric acid and alcohol ("Nital") is suitable as etching agent. The needles are then counted in a particular area (a number N being obtained), and their mean length L is determined. Finally the product from mean length L and the number N is divided by the considered area F. The linear needle density DL is thus defined as $$DL=N\times L/F,$$

and if the surface F is expressed in $m^2$ and the length L in m, the DL has the dimension $m^{-1}$.

A further possibility to bring the produced sound characteristics of the finished instrument into relation with the thorough nitriding carried out consists in determination of the area proportion of the precipitated iron nitride crystals in the total area of a cross-section image. To do this it is of course necessary to determine not only the length L of the individual crystal needles, but also their (mean) width.

An image that serves this purpose is obtained, for example, using REM technology (REM=Raster Electron Microscopy). For this purpose an REM image is made of a section through the material, and the area proportion of the crystal needles is obtained either through electronic processing of the gray scale values of the image (the precipitated crystals appear lighter than the iron matrix) or through color analysis of a stained section image.

The mentioned analytical methods are quickly carried out and produce good reference values for the final characteristics to be obtained. An estimate of the precision of the two analytical methods results in about ±10%, which completely suffices in practice. It is readily possible to refine the methods in order to obtain more precise values, which, as a rule, is not necessary, however, and only leads to higher costs.

Investigations on several steel samples have shown that the preferred characteristics according to the invention of the finished instrument, which result from the thorough nitriding throughout, are achieved with density values of $40\cdot10^3\ m^{-1}$ to $80\cdot10^3\ m^{-1}$ and area proportions for the iron nitrides of 10 to 50%.

For the purpose of prevention of corrosion and also to improve the appearance, the completely nitrided throughout steel sheets can be blued before, during and after the further treatment. To do this, the workpiece or respectively the instrument is put in a blueing bath. Such a bath consists, for example, of 3500 ml Wasser, 1700 g NaOH, 105 g $NaNO_2$ and 450 g $NaNO_3$. The workpiece is put in the bath (25° C.) and taken out as soon as the desired blueing has occurred.

The invention is now to be explained further with reference to a method example. It is to be pointed out that this example does not limit the invention as concerns either the selection of the materials and additives or the method conditions used.

EXAMPLE

The mechanical data and method steps correspond largely to the example given in the patent document CH-693319. For details, reference is made to this document.

A circular deep-drawing sheet having a diameter of 80 cm and a thickness of 0.9 mm is deep drawn over a domed former made of steel having a diameter of 600 mm and a height of about 215 cm <sic. mm>. The material of the sheet metal was steel DC04 (0.08% C max.; 0.03% P max.; 0.03% S max.; 0.04% Mn max.; residual C; Rm 270-350 $N/mm^2$, Re 210 $N/mm^2$; elongation 38% min.). Two steel shells were produced in a completely identical way.

The two deep-drawn steel shells obtained were cut to size forming a foldable edge, which was folded up and inward. Then, after thorough cleaning, the workpieces were brought into a gas nitriding oven and were nitrided there in an ammonia atmosphere (pressure 2.8 bar) at a temperature of between 570° C. and 585° C. for 145 hours.

Figure 3:
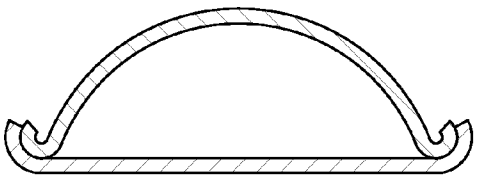
Figure 1:
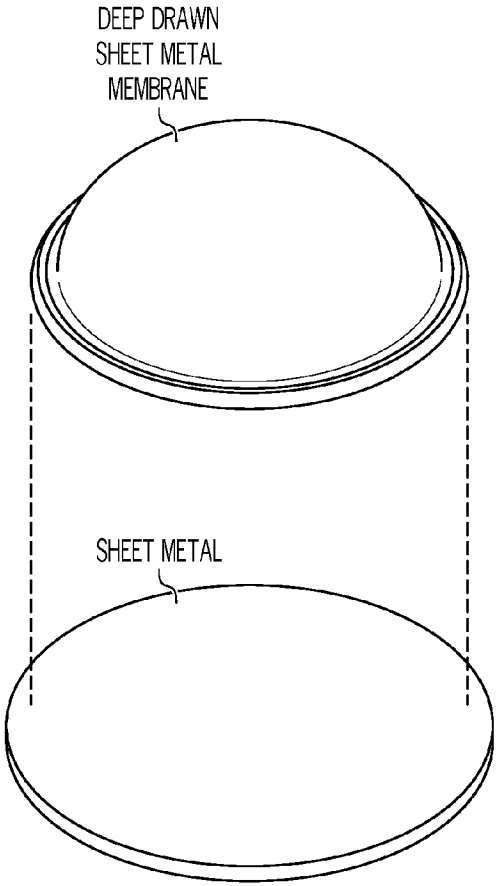

After slow cooling to room temperature, the one shell was further processed into the finished Hang® according to the example of the printed patent specification CH-693319, and as illustrated schematically in FIGS. 1-3. FIG. 1 illustrates the deep-drawn sheet steel membrane being brought into contact with another steel sheet to form the hollow instrument. FIG. 2 illustrates those sheets in contact and FIG. 3 illustrates them being joined. The instrument was distinguished by a full sound with strong metallic, almost clanging tone, which could be slightly lessened, but also intensified during playing.

The second steel shell was cut diametrically, and small samples were prepared according to known techniques for polished micrograph sections. The linear density of the precipitated iron nitride crystals was determined to be $58500\ m^{-1}$ and the area proportion of the crystals to be 21%. The precipitated crystals were thereby distributed almost evenly over the entire section of the sheet metal, with the exception of the two surface layers that represent the connection layer and each have a mean thickness of 22 μm. The analysis of these layers took place by stippling with a 12% aqueous solution of copper ammonium chloride ($(NH_4)_2[CuCl_4].2\ H_2O$) at 25° C.

The invention can be further developed and modified, and these changes made by one skilled in the art lie within the scope of protection. In particular all nitriding methods that are described and/or claimed in the printed patent specification CH-693319 discussed above can also be applied, after corresponding adaptation, in the method according to the invention.

What is claimed is:

1. A method for production of a metallic-sounding musical instrument, which has a vibration-producing sheet metal membrane, in the method (a) a steel sheet blank being deep-drawn, forming a sheet metal membrane, (b) the sheet metal membrane obtained being hardened by nitriding and (c) the hardened sheet metal membrane being joined to a second piece of shaped sheet metal to form a hollow instrument body, wherein the nitriding mentioned in step (b) is carried out under conditions which result in a thorough nitriding throughout of the sheet metal membrane.

2. The method according to claim 1, wherein the nitriding is carried out with treatment periods of over 100 hours.

3. The method according to claim 1, wherein the nitriding takes place by gas nitriding in an ammonia atmosphere.

4. The method according to claim 1, wherein the nitriding is carried out by plasma nitriding at 400° C. to 600° C.

5. The method according to claim 1, wherein nitriding is carried out to a linear density of precipitated needle-shaped iron nitride crystals in the range of 40000 to 80000 $m^{-1}$.

6. The method according to claim 1, wherein the nitriding is carried out to an area proportion of precipitated needle-shaped iron nitride crystals in the range of 10% to 50%.

7. The method according to claim 1, wherein the complete nitriding throughout is determined by measurement of precipitated iron nitride crystals on polished micrograph sections of the nitrided workpieces.

8. The method according to claim 1, wherein the nitrided workpiece is subjected to a surface blueing procedure.

9. A metallic-sounding musical instrument obtained according to claim 1.

10. The method according to claim 2, wherein the nitriding takes place by gas nitriding in an ammonia atmosphere.

11. The method according to claim 10, wherein the nitriding is carried out by plasma nitriding at 400° C. to 600° C.

12. The method according to claim 11, wherein nitriding is carried out to a linear density of precipitated needle-shaped iron nitride crystals in the range of 40000 to 80000 $m^{-1}$.

13. The method according to claim 11, wherein the nitriding is carried out to an area proportion of precipitated needle-shaped iron nitride crystals in the range of 10% to 50%.

14. The method according to claim 13, wherein the complete nitriding throughout is determined by measurement of precipitated iron nitride crystals on polished micrograph sections of the nitrided workpieces.

15. The method according to claim 12, wherein the complete nitriding throughout is determined by measurement of precipitated iron nitride crystals on polished micrograph sections of the nitrided workpieces.

16. The method according to claim 15, wherein the nitrided workpiece is subjected to a surface blueing procedure.

17. The method according to claim 14, wherein the nitrided workpiece is subjected to a surface blueing procedure.

* * * * *

UNITED STATES PATENT AND TRADEMARK OFFICE

CERTIFICATE OF CORRECTION

PATENT NO. : 8,552,279 B2
APPLICATION NO. : 13/378488
DATED : October 8, 2013
INVENTOR(S) : Felix Rohner and Sabina Scharer It is certified that error appears in the above-identified patent and that said Letters Patent is hereby corrected as shown below:

At the 7th line of item (57) on the Title page of the patent, please replace $40 \cdot 10 \cdot 10^3\ m^{-1}$ with $40 \cdot 10^3\ m^{-1}$.

Signed and Sealed this
Twenty-eighth Day of January, 2014

Michelle K. Lee

Michelle K. Lee
*Deputy Director of the United States Patent and Trademark Office*

US008552279C1

(12) EX PARTE REEXAMINATION CERTIFICATE (10654th)

United States Patent

Rohner et al.

(10) Number: US 8,552,279 C1

(45) Certificate Issued: Jul. 9, 2015

(54) METHOD FOR PRODUCTION OF A METALLIC-SOUNDING MUSICAL INSTRUMENT

(75) Inventors: Felix Rohner, Bern (CH); Sabina Scharer, Bern (CH)

(73) Assignee: PANART HANGBAU AG, Bern (CH)

Reexamination Request:
No. 90/013,288, Jul. 11, 2014

Reexamination Certificate for:

| | |
|---|---|
| Patent No.: | **8,552,279** |
| Issued: | **Oct. 8, 2013** |
| Appl. No.: | **13/378,488** |
| PCT Filed: | **Jun. 16, 2009** |
| PCT No.: | **PCT/EP2009/057466** |
| § 371 (c)(1), (2), (4) Date: | **Dec. 15, 2011** |
| PCT Pub. No.: | **WO2010/145695** |
| PCT Pub. Date: | **Dec. 23, 2010** |

Certificate of Correction issued Jan. 28, 2014

(51) Int. Cl.
*G10D 13/08* (2006.01)

(52) U.S. Cl.
CPC ..... *G10D 13/08* (2013.01)

(58) Field of Classification Search
None
See application file for complete search history.

(56) References Cited

To view the complete listing of prior art documents cited during the proceeding for Reexamination Control Number 90/013,288, please refer to the USPTO's public Patent Application Information Retrieval (PAIR) system under the Display References tab.

*Primary Examiner* — Cameron Saadat

(57) ABSTRACT

Indicated is a method for production of a metallic-sounding musical instrument of the steelpan-type, in particular for production of a Hang®. In the method the steel sheet with a thickness of 0.75 to 1.25 mm required for the production is nitrided until the sheet is completely permeated with iron nitride needles. The linear density of the needles is, as a rule, between $40 \cdot 10 \cdot 10^3$ $m^{-1}$ to $80 \cdot 10^3$ $m^{-1}$. The type of nitriding can be selected freely. The thus obtained instrument is characterized by novel tones.

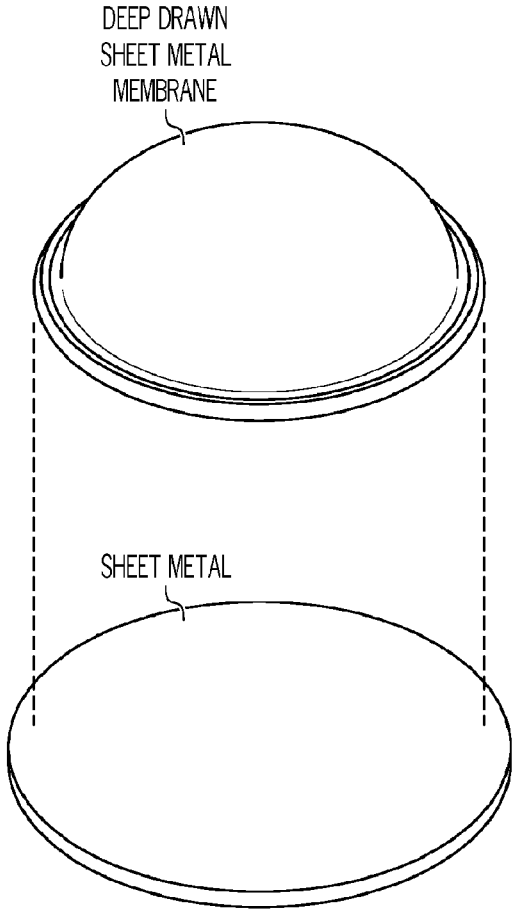

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-4 and 7-17 are cancelled.

Claims 5 and 6 are determined to be patentable as amended.

New claims 18-34 are added and determined to be patentable.

5. [The method according to claim 1] *A method for production of a metallic-sounding musical instrument, which has a vibration-producing sheet metal membrane, in the method (a) a steel sheet blank being deep-drawn, forming a sheet metal membrane, (b) the sheet metal membrane obtained being hardened by nitriding and (c) the hardened sheet metal membrane being joined to a second piece of shaped sheet metal to form a hollow instrument body, wherein the nitriding mentioned in step (b) is carried out under conditions which result in a thorough nitriding throughout the sheet metal membrane*, wherein *said* nitriding is carried out to *yield* a linear density of precipitated needle-shaped iron nitride crystals in the range of 40000 to 80000 $m^{-1}$.

6. [The method according to claim 1] *A method for production of a metallic-sounding musical instrument, which has a vibration-producing sheet metal membrane, in the method (a) a steel sheet blank being deep-drawn, forming a sheet metal membrane, (b) the sheet metal membrane obtained being hardened by nitriding and (c) the hardened sheet metal membrane being joined to a second piece of shaped sheet metal to form a hollow instrument body, wherein the nitriding mentioned in step (b) is carried out under conditions which result in a thorough nitriding throughout the sheet metal membrane*, wherein the nitriding is carried out to *yield* an area proportion of precipitated needle-shaped iron nitride crystals in the range of 10% to 50%.

*18. The method according to claim 5, wherein the nitriding is carried out for over 100 hours.*

*19. The method according to claim 5, wherein the nitriding takes place by gas nitriding in an ammonia atmosphere.*

*20. The method according to claim 5, wherein the nitriding is carried out by plasma nitriding at 400° C. to 600° C.*

*21. The method according to claim 5, wherein the hardened sheet metal membrane is subjected to a surface blueing procedure.*

*22. The method according to claim 6, wherein the nitriding is carried for over 100 hours.*

*23. The method according to claim 6, wherein the nitriding takes place by gas nitriding in an ammonia atmosphere.*

*24. The method according to claim 6, wherein the nitriding is carried out by plasma nitriding at 400° C. to 600° C.*

*25. The method according to claim 6, wherein the hardened sheet metal membrane is subjected to a surface blueing procedure.*

*26. The method according to claim 5, wherein the hardened sheet metal membrane has an area proportion of precipitated needle-shaped iron nitride crystals in the range of 10% to 50%.*

*27. The method according to claim 5, wherein the nitriding takes place by gas nitriding in an ammonia atmosphere for over 100 hours.*

*28. The method according to claim 27, wherein the nitriding is carried out at 400° C. to 600° C.*

*29. The method according to claim 28, wherein the sheet metal membrane has a thickness of 0.75 to 1.25 mm.*

*30. The method according to claim 29, wherein the sheet metal membrane has a thickness of 0.9 to 1 mm.*

*31. The method according to claim 6, wherein the nitriding takes place by gas nitriding in an ammonia atmosphere for over 100 hours.*

*32. The method according to claim 31, wherein the nitriding is carried out at 400° C. to 600° C.*

*33. The method according to claim 32, wherein the sheet metal membrane has a thickness of 0.75 to 1.25 mm.*

*34. The method according to claim 33, wherein the sheet metal membrane has a thickness of 0.9 to 1 mm.*

* * * * *